US005255728A

United States Patent [19]

Nojiri et al.

[11] Patent Number: 5,255,728

[45] Date of Patent: Oct. 26, 1993

[54] AUTOMATIC SPEW TRIMMING METHOD AND APPARATUS USED THEREFOR

[75] Inventors: Yasushi Nojiri, Kobe; Masaaki Yoshida, Kakogawa; Yojiro Miki, Kobe, all of Japan

[73] Assignee: Sumitomo Rubber Industries, Ltd., Hyogo, Japan

[21] Appl. No.: 879,274

[22] Filed: May 7, 1992

[30] Foreign Application Priority Data

May 16, 1991 [JP] Japan ..... 3-111465

[51] Int. Cl.[5] ..... B29D 30/00

[52] U.S. Cl. ..... 157/1; 157/13

[58] Field of Search ..... 157/13, 1; 51/165 R

[56] References Cited

U.S. PATENT DOCUMENTS 1,668,214 5/1928 Liebau .
2,986,182 5/1961 Roesch .

FOREIGN PATENT DOCUMENTS 0421827 4/1991 European Pat. Off. .
1729720 7/1971 Fed. Rep. of Germany .
3819551 12/1988 Fed. Rep. of Germany .
1176181 4/1959 France .
0403717 12/1933 United Kingdom .

*Primary Examiner*—D. S. Meislin
*Attorney, Agent, or Firm*—Birch, Stewart, Kolasch & Birch

[57] ABSTRACT

An automatic spew trimming method wherein a tire is rotated while being supported from an inside to be trimmed by a knife and an apparatus used therefor. The apparatus includes a supply conveyer, a tire rotating section, a cutter for tire tread, a cutter for sidewall, and a discharge conveyer. According to the method and the apparatus of the present invention, even a tire such as a motor cycle tire having low rigidity, small tread width and nearly complete round cross section can be trimmed to cut off spew. Further, even if many kinds of tires of different sizes are supplied at random, they can be satisfactorily accommodated and treated.

3 Claims, 11 Drawing Sheets

AUTOMATIC SPEW TRIMMING METHOD AND APPARATUS USED THEREFOR

BACKGROUND OF THE INVENTION

1. Field of the Invention

The present invention relates to an automatic spew trimming method, wherein spew or flash generated in the vulcanizing step can be cut off from external surfaces of various kinds of vulcanized tires. The present invention also relates to an apparatus used for the method.

2. Description of Related Art

Trimming of a vulcanized tire has been conventionally carried out in such a manner that a tire is independently rotated for example by two drive rollers and two guide rollers to be trimmed by a knife. In that case, the rollers are positioned at the outer circumference of the tire. Another conventional trimming is carried out in such a manner that a tire is assembled with a rim and is inflated, thereafter the tire is rotated by rotating the rim to trim the tire with a knife.

However, the above-mentioned two conventional trimming methods have drawbacks respectively. In the method where a tire is independently rotated to be trimmed by a knife, trimming of a low rigidity tire and a tire having much small tread width such as a motor cycle tire is impossible because smooth rotation of such tires is impossible. In this method, even if the apparatus is adjusted or modified, that is, roller pressure is changed or roller figure is specified for a certain tire, to enable the trimming of the tire, the apparatus must be for exclusive use of the very tire so that other kinds of tire can not be trimmed. In the method where a tire is assembled with a rim and is rotated, the rim must be changed depending on the rim diameter for tires of different rim diameter. Thus flexible operation can not be realized for different rim diameters.

In view of the drawbacks of the conventional methods, an object of the present invention is to provide a method for automatically trimming spew and an apparatus used therefor, wherein spew or flash generated in the vulcanizing step can be cut off from an external surface of a vulcanized tire in a single apparatus without parts replacement for many kinds of tires of different rigidity, tread width and size.

SUMMARY OF THE INVENTION

According to the present invention, there is provided an automatic spew trimming method wherein a tire is rotated while being internally supported to be trimmed by a knife.

A trimming method of the present invention may comprise:

a step of measuring an outer diameter of a tire;

a step of measuring a width of the tire;

a step of controlling a position to which a tire is lifted, based on the measured tire width;

a step of determining a fluctuation center of a cutter for tire tread, based on the measured outer diameter of the tire;

a step of determining an amount of fluctuation of the cutter for tire tread, based on the measured tire width; and a step of trimming the tire tread with the cutter for the tire tread, based on the determined fluctuation center and on the determined amount of fluctuation. This method is shown in a block diagram of FIG. 1.

Another trimming method of the present invention may comprise:

a step of measuring a bead diameter as an inner diameter of a tire;

a step of measuring an outer diameter of the tire;

a step of measuring a width of the tire;

a step of controlling a position to which a tire is lifted, based on the measured tire width;

a step of determining a position at which sidewall trimming with a cutter for sidewall is finished, based on the measured inner diameter of the tire;

a step of determining a position from which sidewall trimming with the cutter for sidewall is started, based on the measured outer diameter of the tire; and a step of trimming the sidewall with the cutter for sidewall, based on the determined sidewall trimming finish position and on the determined sidewall trimming start position. This method is shown in a block diagram of FIG. 2.

A further trimming method of the present invention may comprise:

a step of measuring a bead diameter as an inner diameter of a tire;

a step of measuring an outer diameter of the tire;

a step of measuring a width of the tire;

a step of controlling a position to which a tire is lifted, based on the measured tire width;

a step of determining a position at which sidewall trimming with a cutter for sidewall is finished, based on the measured inner diameter of the tire;

a step of determining a position from which sidewall trimming with the cutter for sidewall is started, based on the measured outer diameter of the tire;

a step of determining a fluctuation center of a cutter for tire tread, based on the measured outer diameter of the tire;

a step of determining an amount of fluctuation of the cutter for tire tread, based on the measured tire width;

a step of trimming the sidewall with the cutter for sidewall, based on the determined sidewall trimming finish position and on the determined sidewall trimming start position; and a step of trimming the tire tread with the cutter for tire tread, based on the determined fluctuation center and on the determined amount of fluctuation. This method is shown in a block diagram of FIG. 3.

An inner diameter a, an outer diameter b and a width c of a tire are shown in FIG. 4. Further, a position d at which sidewall trimming is finished, a position e from which sidewall trimming is started and fluctuation amount g of a cutter for tire tread are also shown in FIG. 4. In FIG. 4 h represents an equatorial line of a tire. As shown in FIG. 4, a cutter 10 for tire tread moves in directions indicated by arrows B, C, D and E in this order covering the whole area of the fluctuation amount g. The cutter 10 is moved by a bow-shaped member 14 (refer to FIG. 11) while being pressed in a direction A by a cylinder 16 (refer to FIG. 11). Firstly, the cutter 10 trims a tire while moving in a direction B from a position on the equatorial line, and then quickly returns (in a direction C) to the original position. Secondly, the cutter 10 trims the tire while moving in a direction D, and then quickly returns (in a direction E) to the original position. On the other hand, a cutter 11 for sidewall trims the tire while moving from a trimming start position e to a trimming finish position d. The cutter 11 is moved from the position e to the position d by a supporting bar 18 (refer to FIG. 11) while being pressed in a direction F by a cylinder 19 (refer to FIG. 11). The sidewall trimming start position e is determined by subtracting an amount Δb1 from the measured outer diameter b of the tire. The amount Δb1 is previously selected for a certain specific outer diameter. A fluctuation center f is determined by subtracting an amount Δb2 from the measured outer diameter b of the tire. The amount Δb2 is previously selected for a certain specific outer diameter. Further, the fluctuation amount g of the cutter 10 is determined by subtracting a correction amount Δg from the measured tire width c and calculating a fluctuating angle α from the equatorial line h. The correction amount Δg is previously selected for a certain specific tire width. The above-mentioned selected amount and correction amount which vary depending on tire sizes are previously input in a computer from which they are input into a control means of the trimming apparatus by data communication.

According to the present invention there is provided an apparatus used for automatically trimming spew comprising:

a supply conveyer carrying a tire to a tire rotating section, the tire rotating section having a tire holding mechanism and being positioned downstream of the supply conveyer, and the mechanism having a chuck supporting the tire from inside of the tire; at least one of a cutter for tire tread and a cutter for sidewall each provided at the tire rotating section; and a discharge conveyer continuing from the supply conveyer.

According to the present invention there is also provided an apparatus used for automatically trimming spew comprising:

a supply conveyer carrying a tire to a tire rotating section, the tire rotating section having a tire holding mechanism and being positioned downstream of the supply conveyer, and the mechanism having a chuck supporting the tire from inside of the tire;

a measuring section measuring an inner diameter, an outer diameter and a width of the tire for controlling operation position of cutters, the measuring section being positioned in the vicinity of the supply conveyer; at least one of a cutter for tire tread and a cutter for sidewall each provided at the tire rotating section;

a discharge conveyer continuing from the supply conveyer; and a discharge conveyer continuing from the supply conveyer; and a controlling section memorizing the data measured by the measuring section and controlling movements of at least one of the cutter for tire tread and the cutter for sidewall based on the memorized data.

In the methods and apparatuses of the present invention, a tire is supported from inside, so that spew of the tire can be trimmed even for tires such as a motor cycle tire having low rigidity, small tread width and a nearly complete round cross section. Further, trimming can be carried out without parts replacement even for tires of different bead diameters. Moreover, even if many kinds of tires are supplied to the apparatus at random, the apparatus can satisfactorily accommodate them because information about a tire such as an outer diameter, an inner diameter, a tire width, a spew cut area, the number of spew and the like are previously input and the cutters are moved according to the input information.

DETAILED DESCRIPTION OF PREFERRED EMBODIMENT

Figure 1:
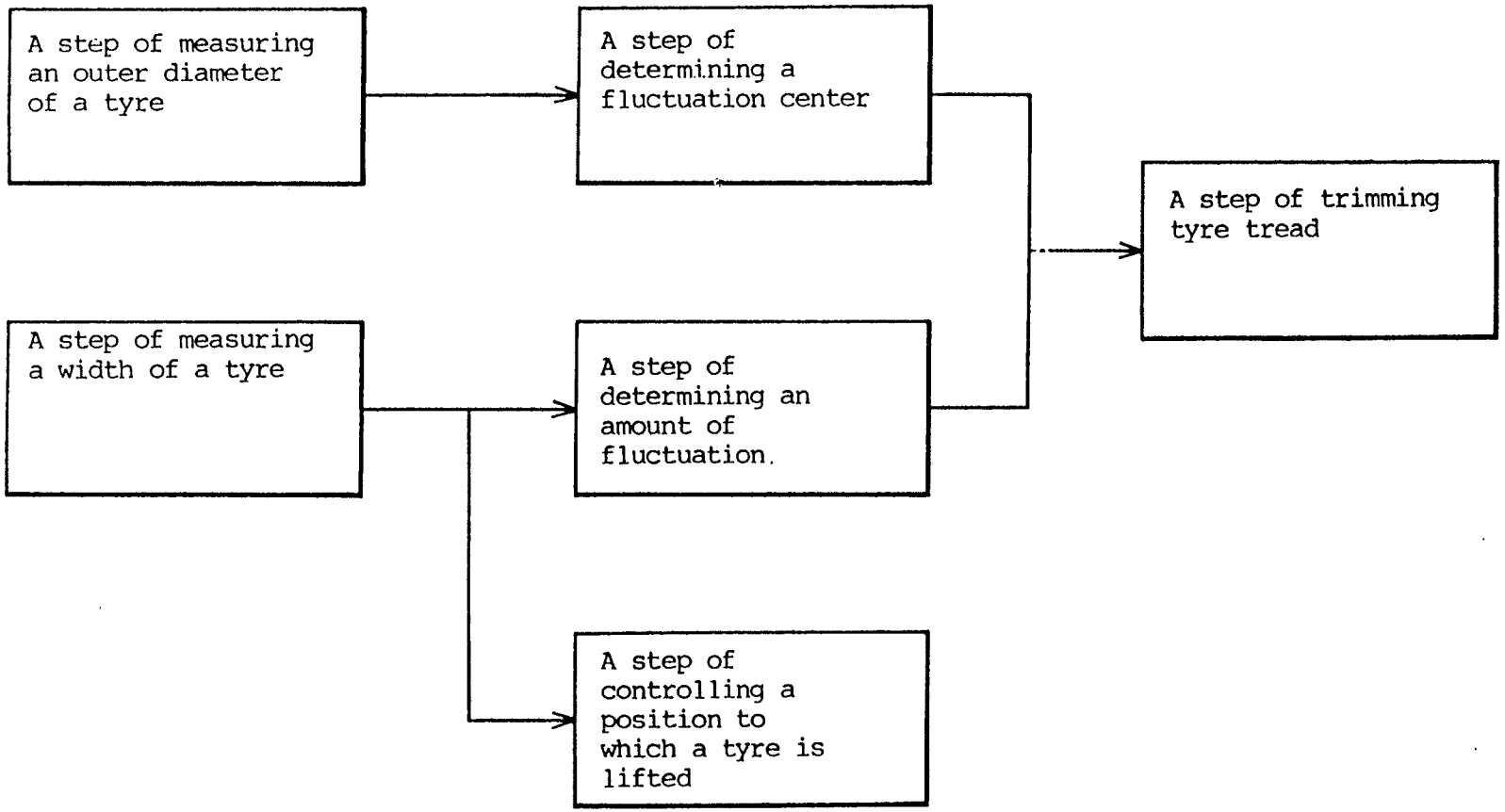
FIGS. 1, 2 and 3 are respectively a block diagram explaining a first trimming method of the present invention.
Figure 2:
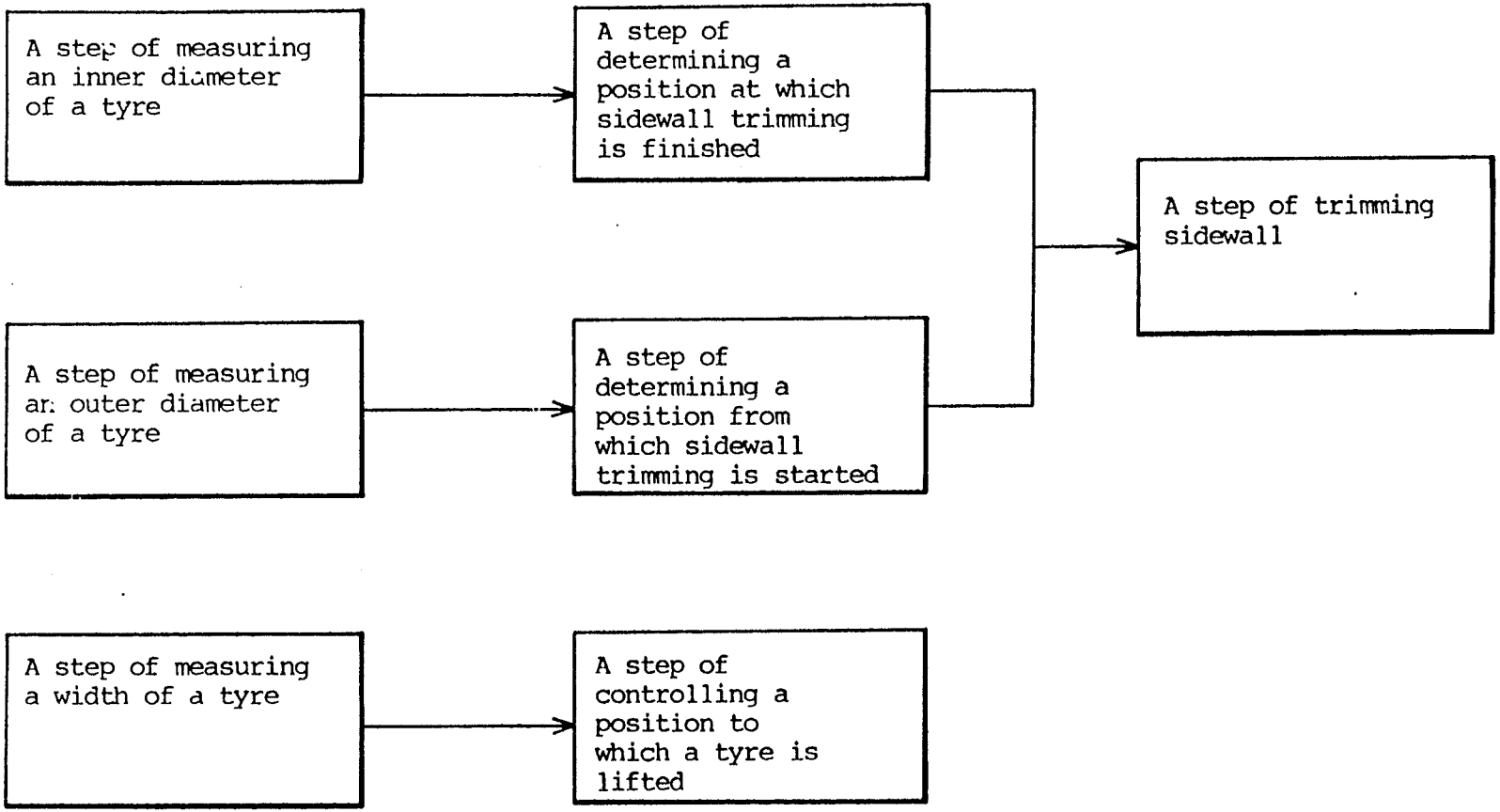

An apparatus of the present invention is explained below with reference to the drawings.

In the apparatus shown in the drawings, when a tire is carried on a conveyer 1 to reach above a tire measuring section 20, the conveyer 1 is stopped and the tire is stopped. Then, four measuring bars 21 for a tire inner diameter of the measuring section 20 move upward from just below the tire to the inside thereof. Then, these four bars 21 move horizontally while being synchronized in radially outward directions along two straight lines crossing at right angles to each other. That is, the bars 21 move in four directions. Thus, centering of the tire and measuring of an inner diameter of the tire are simultaneously carried out.

Figure 8:
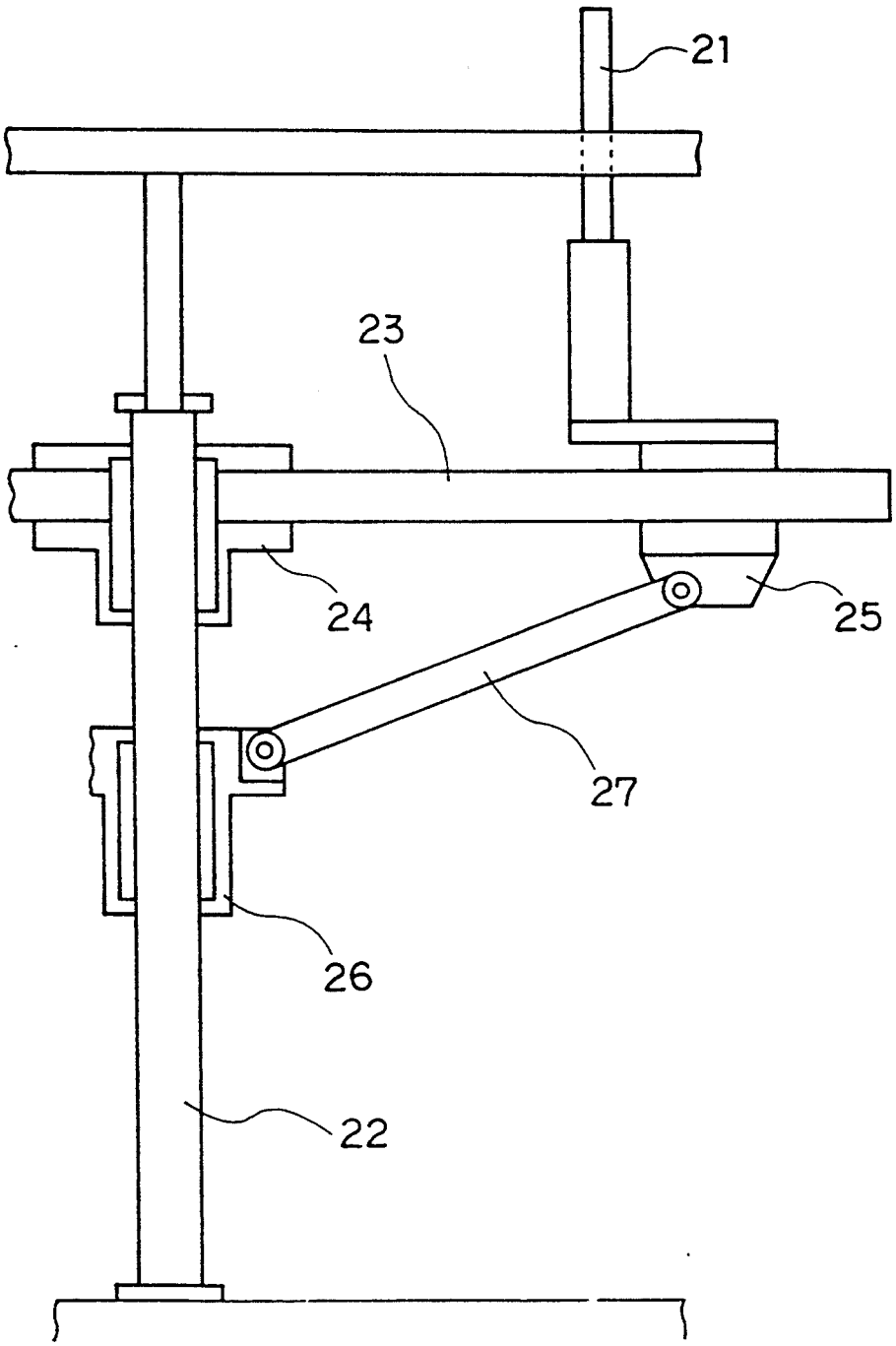
FIG. 8 is a schematic explanatory view of a measuring section in the apparatus of FIG. 5.

The structure of the measuring section 20 is schematically shown in FIG. 8. The operation of the bar 21 is controlled as follows. Four lateral shafts 23 are attached to a first sliding member 24. The shafts 23 extend in four radially outward directions along two straight lines crossing at right angles to each other. Four second sliding members 25 are slidably engaged with respective lateral shafts 23. The bar 21 is fixed to the second member 25. The first member 24, which is slidably engaged with a main shaft 22, is moved upward by an air cylinder (not shown). With the first member 24 moving upward, the second members 25 and four measuring bars 21 move upward. If one of the four second members 25 is moved along the lateral shaft 23 by an air cylinder (not shown), the other three second members 25 are laterally moved while being synchronized because the four second members 25 are connected to one third sliding member 26 via links 27. The third member 26 is positioned below the first member 24 and slidably engaged with the main shaft 22. The main shaft 22 and the four lateral shafts 23 may be covered by bellows or the like so that chip and the like developed in tire trimming are prevented from adhering to them.

An inner diameter of a tire is determined based on an amount of outward movement of the four bars 21. A width and an outer diameter of a tire is determined as follows. In a condition where the determination of an inner diameter is finished, touch bars (not shown) are moved toward a sidewall and a tread respectively from above and sideways. The touch bars are screw-operated by feed screws or the like to approach a tire. When the bars contact with the tire at the sidewall or at the tread, they are stopped with a proximity switch. These stop positions are measured by encoders to calculate a tire width and an outer diameter.

In this embodiment the vertical and horizontal movements of the four bars 21 are realized by air cylinders. However, the bars can be moved by screws or the like instead of the cylinders.

Data obtained in these measuring steps are input to a memory of a control means such as a sequence controller (not shown) and stored therein. Correction values for these data may be communicated with a computer for minute adjustments.

Thereafter the tire is again carried on the conveyer to reach trimming stage 3 and is again stopped. A chuck 60 of a tire holding mechanism 5 is moved downward by an air cylinder 4 and expands its diameter to support the tire from inside. The chuck 60 expands its diameter so as to always outwardly push the inside of the tire at a vicinity of a tire equator. For this reason, the tire can be firmly supported and lifted up independently of its outer diameter and bead diameter. The upward movement of the chuck 60 is controlled based on the calculated tire width so that height of a center line in a tire width direction (the equatorial line in FIG. 4) of the lifted up tire is adjusted to be constant independently of tire width.

Figure 9:
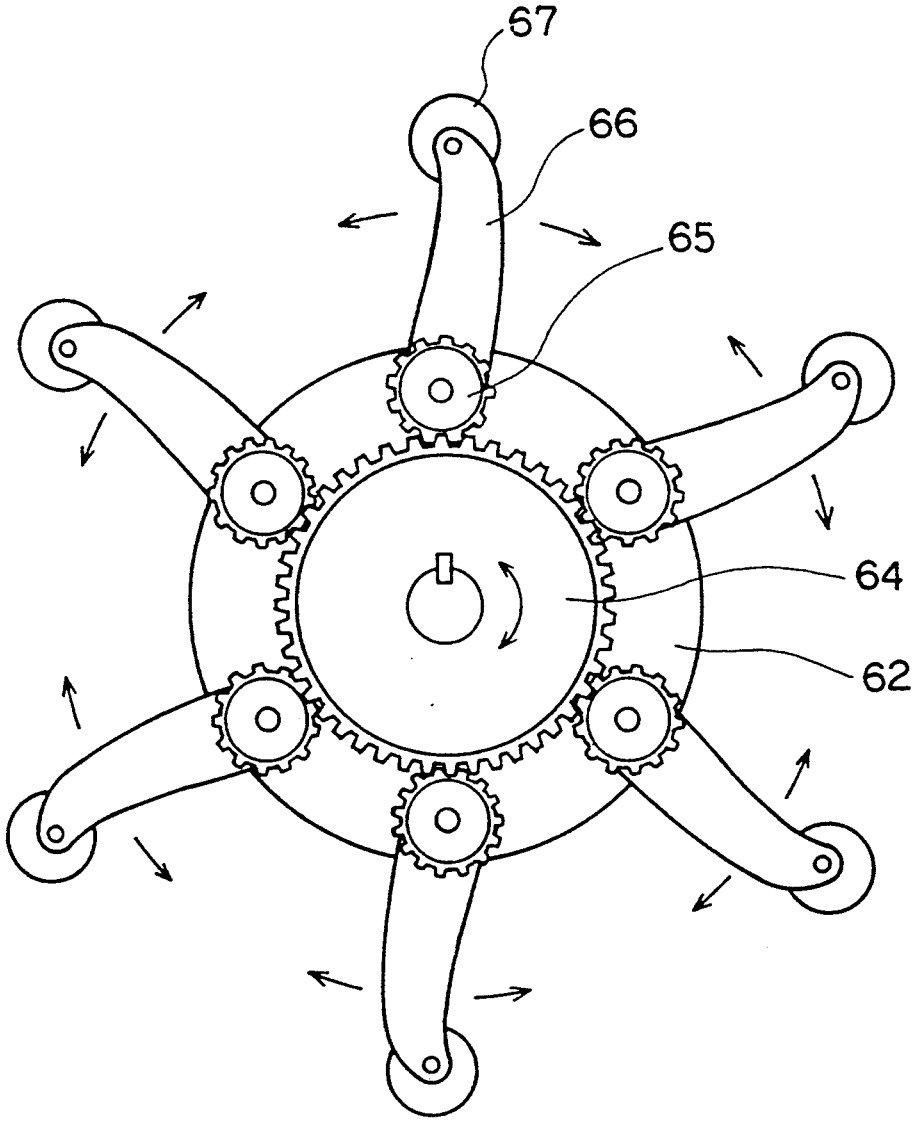
FIGS. 9 and 10 are respectively an explanatory view explaining an expansion and shrinkage mechanism of a chuck in the apparatus of FIG. 5.
Figure 10:
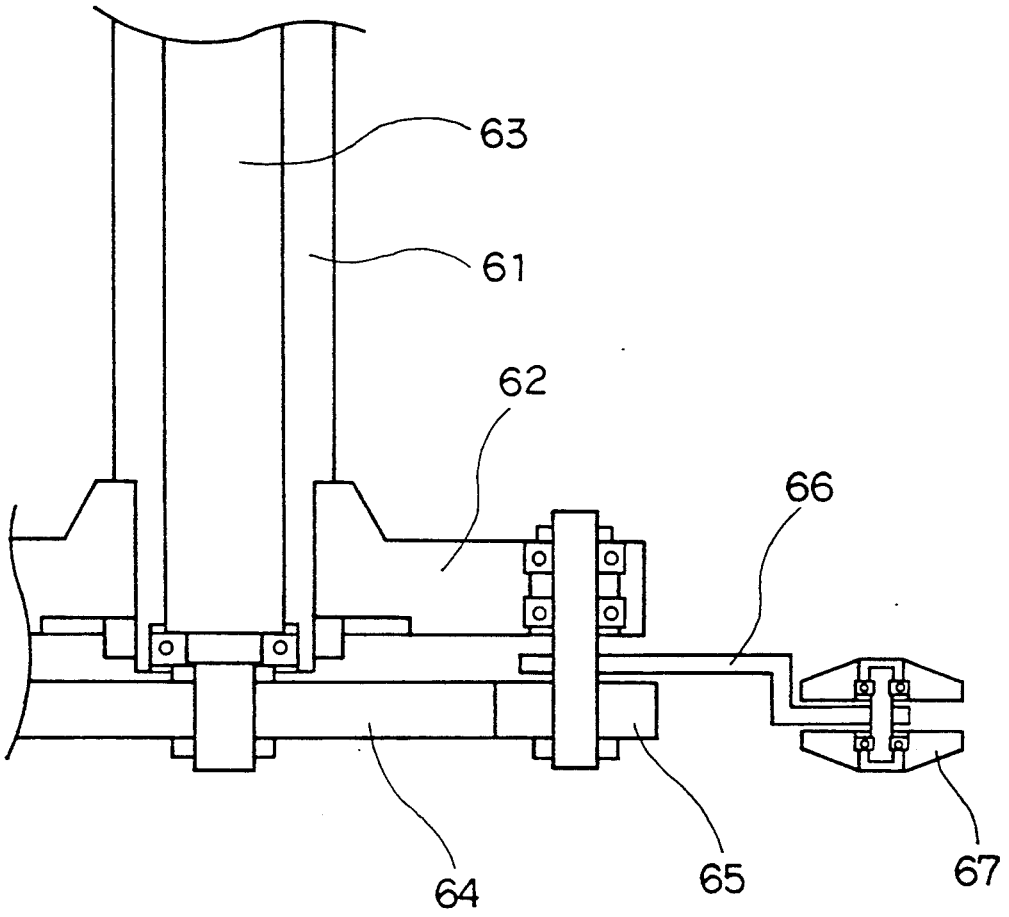

The mechanism of expansion and shrinkage of the chuck 60 is shown in FIGS. 9 and 10. FIG. 9 is a view seen from below of the chuck 60. The chuck 60 comprises a circular plate 62 fixed to a hollow main shaft 61 and a major gear 64 fixed to an inner shaft 63 penetrating through the hollow main shaft 61. Six minor gears 65 are pivotably supported by the circular plate 62. The minor gears are engaged with the major gear 64. When the inner shaft 63 is rotated by a rotary actuator 8 placed on a tire rotating section 7, the major gear 64 and the minor gears 65 are also rotated. An arm 66 is fixed to each of the minor gears 65 so that rotation of the gear 65 causes the arm 66 to open or close. At a tip of the arm 66 a roller 67 is provided, whereby only a tire which is supported by the rollers 67 while being forced outwardly can be rotated by a drive roller 9. The drive roller 9 rotates while contacting with the tire from outside.

As an alternative proposal for the chuck supporting a tire to trim it and for the drive roller, there can be considered a manner that a tire is supported from inside by a chuck and the tire is rotated by rotating the chuck and a manner that a tire is supported at its bead to be rotated. However, in the former manner because the chuck and the tire are integrally rotated and the tire tread is forced by the chuck from inside, spew in the vicinity of the forced tread is difficult to trim. In the latter manner, because the tire is supported at its bead, trimming in the vicinity of the supported bead is apt to be difficult or impossible due to interference of cutters and supporting members. In the above embodiment of the present invention, however, a tire is supported from inside and is independently rotated by the drive roller 9 arranged outside the tire during the trimming operation, whereby the above-mentioned drawbacks are overcome. Thus, according to the present invention, the trimming operation can be carried out well even for a tire such as a motor cycle tire having small width, nearly complete round cross section and low rigidity, which has not been automatically trimmed.

When the tire is lifted up, the drive roller 9 advances toward the lifted up tire to contact therewith. The tire is rotated by the rotation of the roller 9. The sequence control (not shown) as a control means operates a servo mechanism (not shown) so that the movements of the cutter 10 for tire tread and the cutter 11 for sidewall are controlled based on the memorized data. Thus, the cutter 10 trims spew at a tire tread and the cutter 11 trims spew at a sidewall. The control of the cutters 10 and 11 at this stage is carried out according to the block diagram shown in FIG. 3.

Figure 11:
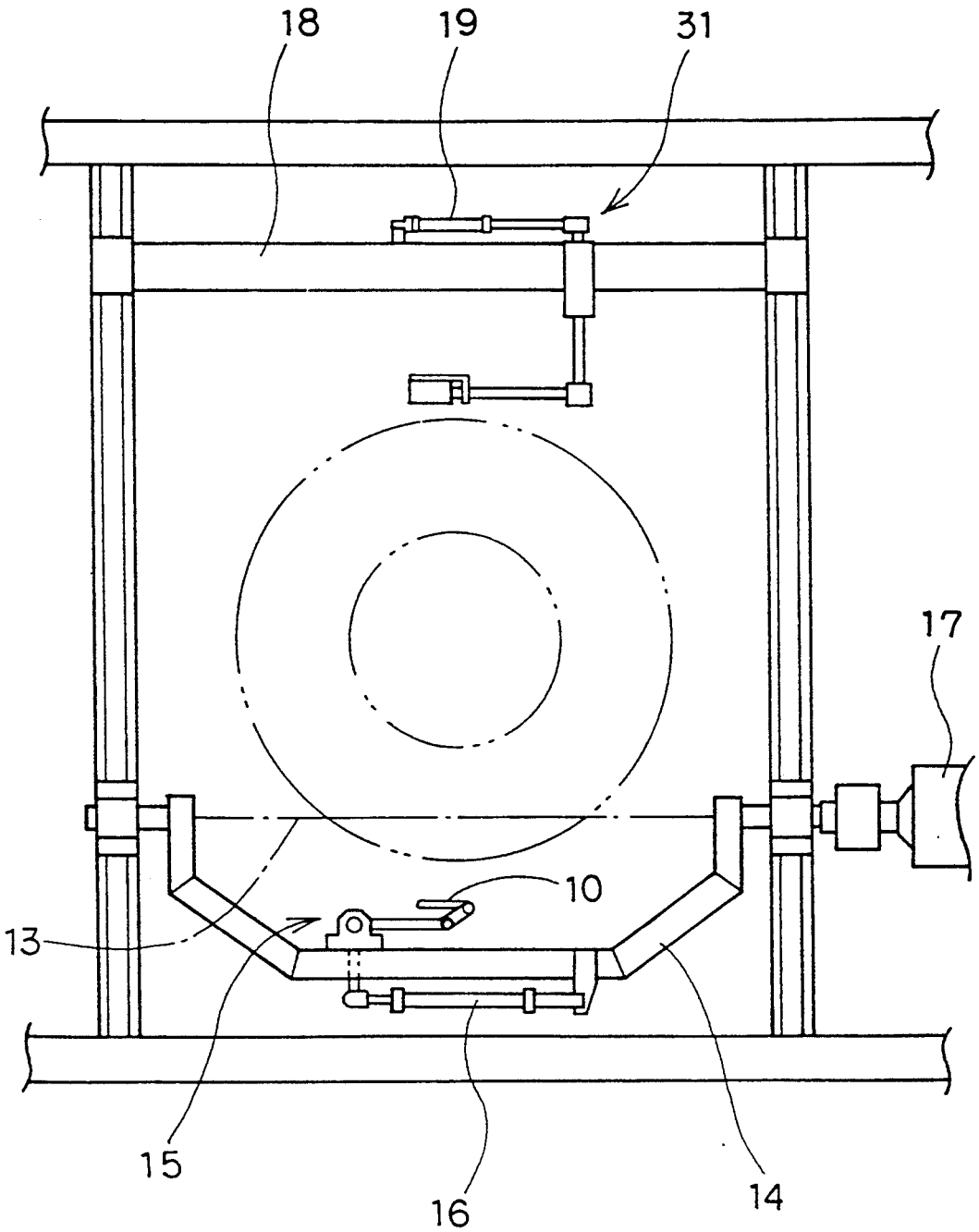
FIG. 11 is an explanatory view of cutters.

Next, the movements of the cutters 10 and 11 are explained below with reference to FIGS. 3, 4 and 11.

Figure 3:
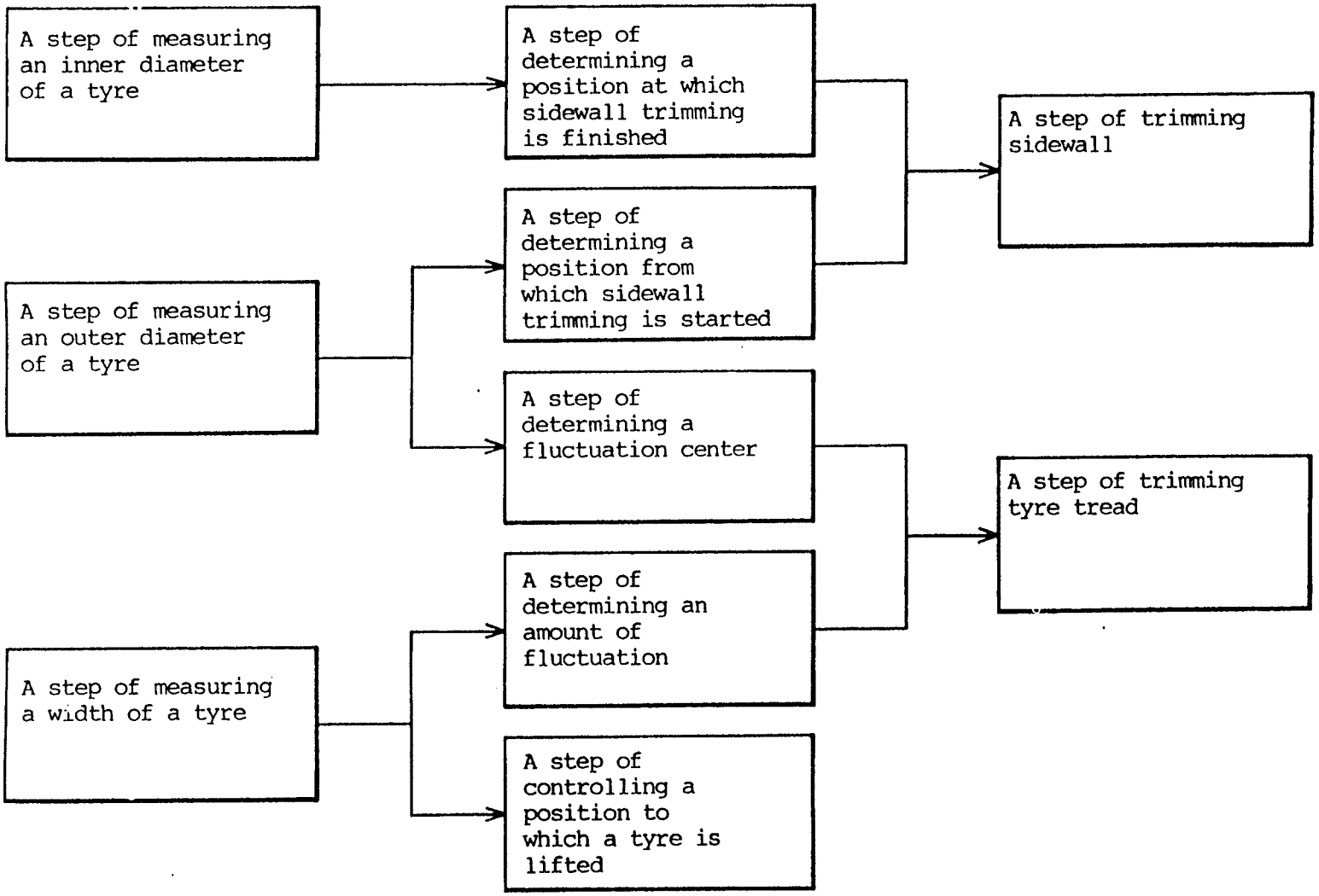
Figure 4:
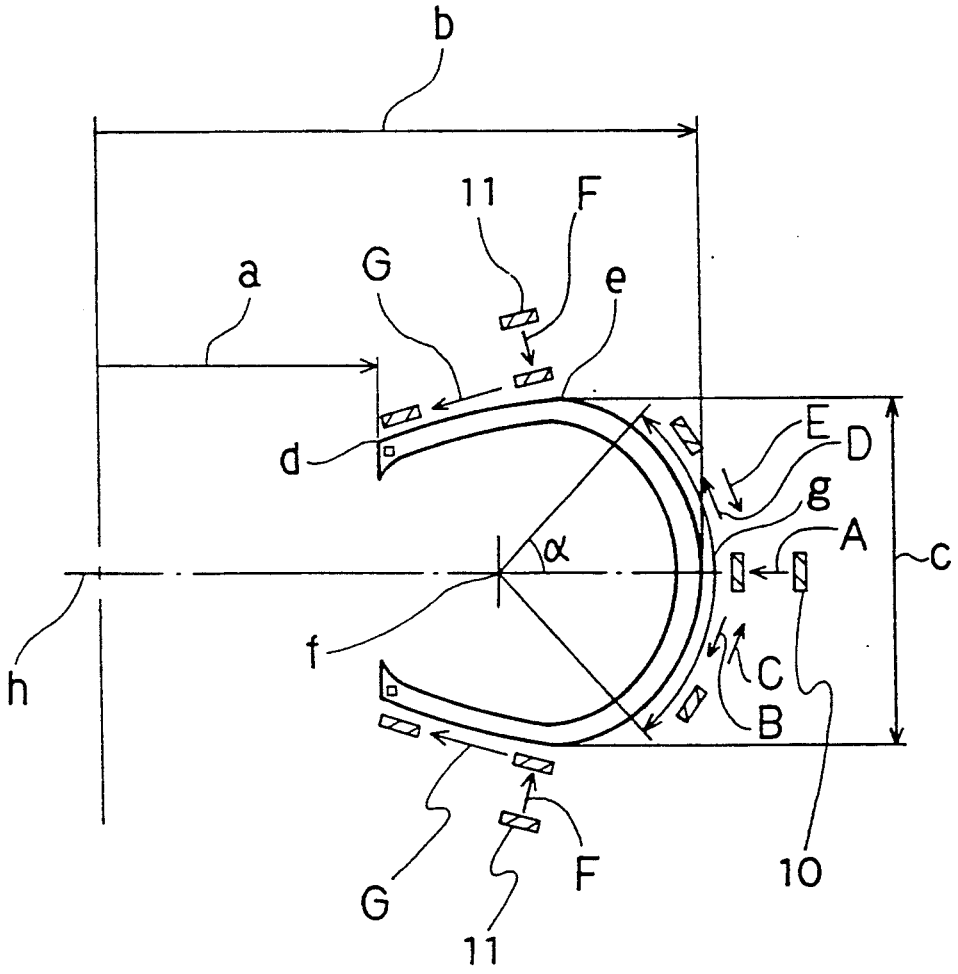
FIG. 4 is an explanatory view explaining concepts, in the present invention, of an inner diameter, an outer diameter and the like of a tire.
Figure 5:
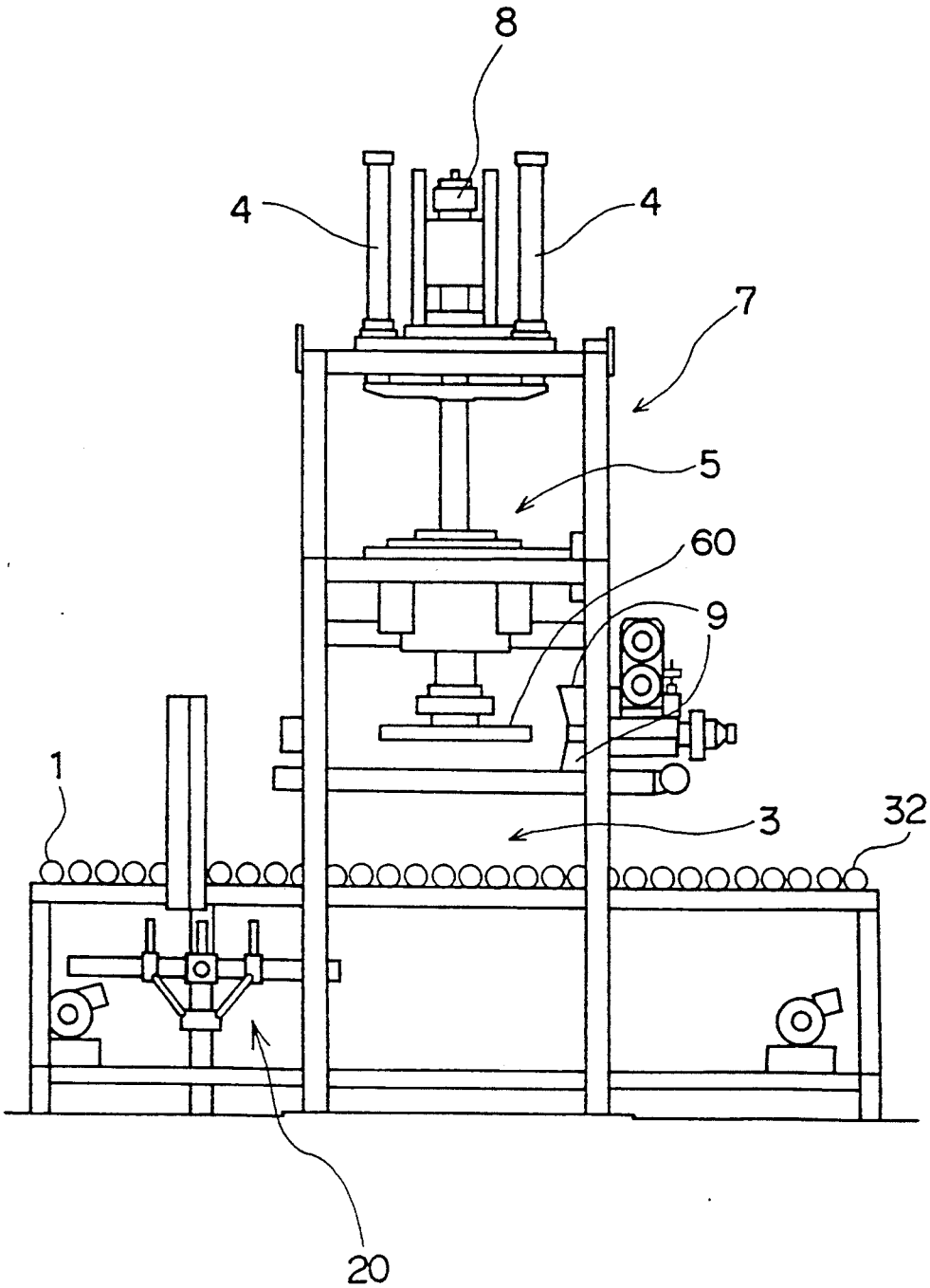
FIG. 5 is a schematic side view of an apparatus of the present invention.
Figure 6:
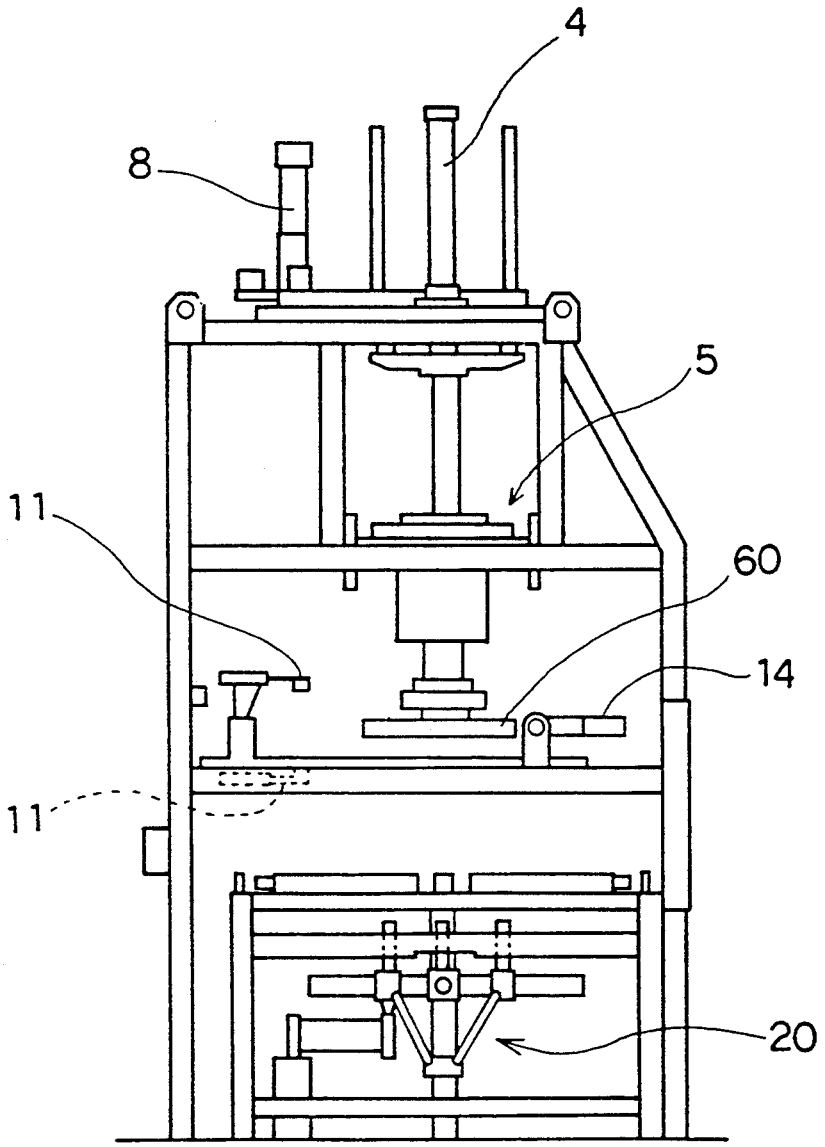
FIG. 6 is a schematic front view of the apparatus in FIG. 5.
Figure 7:
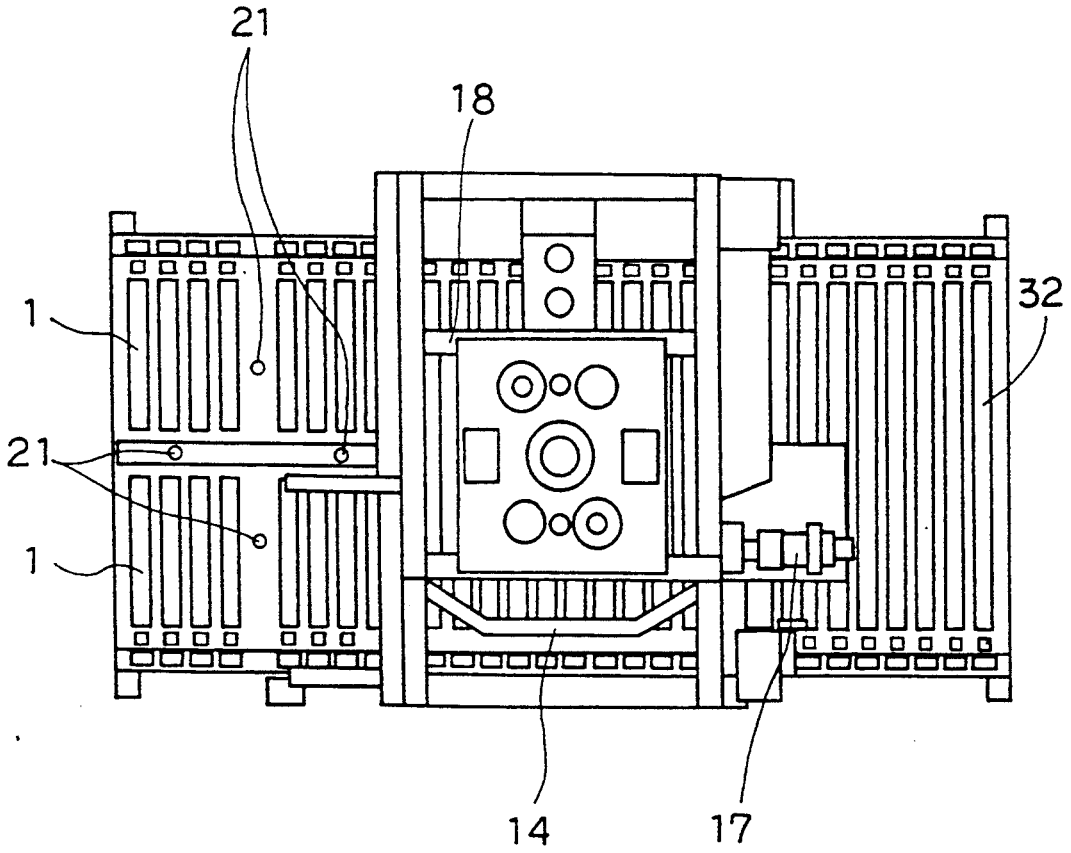
FIG. 7 is a schematic plan view of the apparatus in FIG. 5.

With a value of the measured tire width in the step of measuring a width of a tire in the diagram of FIG. 3, vertical movement of the chuck 60 is controlled so that height of the center line in a width direction (the equatorial line in FIG. 4) of the lifted tire in the trimming position is adjusted to be constant independently of tire width. A bow-shaped member 14, which is nearly arc-shaped, is moved by a servo motor (not shown) so that a shaft center 13 corresponds to the fluctuation center determining in the step of determining a fluctuation center. A bell crank mechanism 15 is operated by an air cylinder 16, whereby the cutter 10 for tire tread contacts with tire tread. Simultaneously, the bow-shaped member 14 is moved by a servo motor 17 over the fluctuation amount g shown in FIG. 4 to trim a tire tread.

A supporting bar 18 for the cutter 11 for sidewall is moved by a servo motor (not shown) from a trimming start position, determined in the step of determining a start position (refer to FIG. 3), to a trimming finish position, determined in the step of determining a finish position (refer to FIG. 3). In this movement (refer to FIG. 4), a rack and pinion mechanism 31 is operated by an air cylinder 19 so that the cutter 11 contacts with a sidewall to trim.

As explained above, the cutters are moved depending on a specific range for spew cutting and on a specific number of spew, which are calculated from the information (outer diameter, inner diameter, tire width and the like) about a tire previously input into a control means (sequence controller). For this reason, even if many kinds of tires of different sizes are supplied at random, the apparatus of the present invention can satisfactorily accommodate and treat them.

When the trimming is finished, the chuck 60 reduces its diameter to unchuck the tire. The unchucked tire falls on the conveyer and is carried on a discharge conveyer 32 to subsequent steps.

According to the methods and the apparatuses of the present invention, the trimming operation can be carried out even for a tire such as a motor cycle tire having low rigidity, small tread width and nearly complete round cross section. Further, even if many kinds of tires of different sizes are supplied, they can be satisfactorily accommodated and treated.

Though embodiments of the invention are described above, it is to be understood that the present invention is not limited to the above-mentioned embodiments, and various changes and modifications may be made in the invention without departing from the spirit and scope thereof.

What we claim is:

1. An automatic spew trimming method comprising:

a step of measuring an outer diameter of a tire;
a step of measuring a width of the tire;
a step of controlling a position to which the tire is lifted, based on the measured tire width;
a step of determining a fluctuation center of a cutter for tire tread, based on the measured outer diameter of the tire;
a step of determining an amount of fluctuation of the cutter for tire tread, based on the measured tire width; and
a step of trimming the tire tread with the cutter for tire tread, based on the determined fluctuation center and on the determined amount of fluctuation.

2. An automatic spew trimming method comprising:
a step of measuring a bead diameter as an inner diameter of a tire;
a step of measuring a bead diameter as an inner diameter of a tire;
a step of measuring an outer diameter of the tire;
a step of measuring a width of the tire;
a step of controlling a position to which a tire is lifted, based on the measured tire width;
a step of determining a position at which sidewall trimming with a cutter for sidewall is finished, based on the measured inner diameter of the tire;
a step of determining a position from which sidewall trimming with the cutter for sidewall is started, based on the measured outer diameter of the tire; and
a step of trimming the sidewall with the cutter for sidewall, based on the determined sidewall trimming finish position and on the determined sidewall trimming start position.

3. An automatic spew trimming method comprising:
a step of measuring a bead diameter as an inner diameter of a tire;
a step of measuring an outer diameter of the tire;
a step of measuring a width of the tire;
a step of controlling a position to which a tire is lifted, based on the measured tire width;
a step of determining a position at which sidewall trimming with a cutter for sidewall is finished, based on the measured inner diameter of the tire;
a step of determining a position from which sidewall trimming with the cutter for sidewall is started, based on the measured outer diameter of the tire;
a step of determining a fluctuation center of a cutter for tire tread, based on the measured outer diameter of the tire;
a step of determining an amount of fluctuation of the cutter for tire tread, based on the measured tire width;
a step of trimming the sidewall with the cutter for sidewall, based on the determined sidewall trimming finish position and on the determined sidewall trimming start position; and
a step of trimming the tire tread with the cutter for tire tread, based on the determined fluctuation center and on the determined amount of fluctuation.

* * * * *